US006199737B1

(12) United States Patent
Ringelstetter

(10) Patent No.: US 6,199,737 B1
(45) Date of Patent: Mar. 13, 2001

(54) SANITARY ANIMAL WASTE COLLECTION HOLDER

(76) Inventor: Nicholas Clement Ringelstetter, E9919A Second St., Prairie duSac, WI (US) 53578

( * ) Notice: Subject to any disclaimer, the term of this patent is extended or adjusted under 35 U.S.C. 154(b) by 0 days.

(21) Appl. No.: 09/415,611

(22) Filed: Oct. 9, 1999

Related U.S. Application Data

(63) Continuation-in-part of application No. 09/282,005, filed on Mar. 29, 1999.

(51) Int. Cl.[7] ..... A45F 5/00; A45C 15/00

(52) U.S. Cl. ..... 224/675; 224/236; 224/249; 224/579; 224/681; 150/108; 150/117; 190/102; 190/109; 190/111; 383/38; 383/40

(58) Field of Search ..... 224/191, 235, 224/236, 249, 251, 660, 674, 675, 680, 684, 615, 577, 578–580; 383/38, 40, 110; 150/106, 108, 112, 117; 190/102, 109, 111

(56) References Cited

U.S. PATENT DOCUMENTS 3,575,326 * 4/1971 Chappell ..... 224/148.5 X
4,796,790 * 1/1989 Hamilton ..... 224/680 X
4,948,023 * 8/1990 Tripp ..... 224/148.5 X
5,205,448 * 4/1993 Kester et al. ..... 224/236 X
5,570,824 * 11/1996 Lyon et al. ..... 224/675 X
5,702,038 * 12/1997 Miller et al. ..... 150/108 X
5,868,227 * 2/1999 Garcia ..... 150/106 X

* cited by examiner

*Primary Examiner*—Gregory M. Vidovich
(74) *Attorney, Agent, or Firm*—Sidney N. Fox

(57) ABSTRACT

A sanitary pet-waste collection pouch having front, rear and side-walls defining an interior open topped chamber for holding tied pet-waste loaded plastic litter bags containing retrieved pet-waste. The rear wall is extended forming a unitary flap cover having interior opening and exterior opening pockets on opposite sides threof. The exterior opening pocket is closed by a "hook and pile" Velcro closure. An open topped side-pocket having a restricted bottom opening is secured along a side-wall of the pouch. A sanitizer dispensing container with a dispensing cap is seated securely within the side-pocket with the dispensing cap passing through the restricted bottom opening. The flap cover carries the "hook" portion of a second "hook and pile" Velcro closure and the front wall carries the "pile" portion of said closure, the "pile" portion being longer than the "hook" portion and being located on the front wall. The flap cover is fitted over the chamber so that the "hook" portion engages the "pile" portion at any location along the length thereof dependent upon the girth of the pouch. A pair of retainer loops carrying a "hook and pile" closure are secured to the pouch's side walls to permit carrying of the pouch by the pet-owner or by the pet.

21 Claims, 2 Drawing Sheets

SANITARY ANIMAL WASTE COLLECTION HOLDER

REFERENCE TO PENDING APPLICATIONS

This application is a continuation-in-part of my pending patent application Ser. No. 09/282,005 filed Mar. 29, 1999.

FIELD OF THE INVENTION

This invention relates generally to animal waste collection and more particularly provides an improved sanitary animal waste collection pouch which is compartmentalized, expandable yet adjustably closable and sealable, capable of temporarily storing sealed containers holding pet waste, of holding and dispensing a supply of fresh plastic litter bags suitable for holding retrieved pet waste, of safely storing the personal effects of the pet owner user and can be carried by the pet owner, the pet leash or by the pet and, particularly, includes an easily accessable hand-sanitizer dispenser for use by the pet owner.

BACKGROUND OF THE INVENTION

The art has long sought sanitary means for retrieving and collecting animal waste matter, particularly fecal material deposited by domestic animals pets, such as dogs, traveling with their owner along the public ways, such as in city side-walks, park trails, public and private lawns, school yards and public and private urban and country areas. Many states, cities and municipalities have enacted laws requiring domestic animal owners to restrain the pet animals by having them coupled to a leash while traveling along the public way, and, further, to enforce the retrieval of their fecal deposits. Simply put, the pet owners are required to "clean-up" after their dogs to prevent others from stepping in or on the waste and/or to inhibit the health risk associated with the presence of such waste.

The prior art has provided an array of apparatus for use in aiding pet owners with the odious and generally unpleasant task involved in collecting dog feces left by their pets. So-called "pooper scoopers", a newspaper, tissue and plastic litter bags have become a necessary accompaniment to the dog owner walking his or her dog. Not only are the tasks difficult, odious, etc.,the apparatus available for such use often have been ungainly to carry and to use.

Some of these proposed devices provide containers which are box-like with detachable lids so that the feces deposit is scooped manually from its drop site and placed in such container. Containers of such type often have been ungainly to carry and to use.

After "cleaning up" after their dogs, the dog owners have experienced direct "hands on" risk of getting their hands, and possibly, their clothing, fouled when scooping-up the deposit from its location and/or transporting and delivering the retrieved deposit to a sanitary depository facility. The implements used to retrieve the deposit, as well as the holding container, are not easily cleaned after use. In addition, carrying the retrieved deposit until a suitable depositary, such as a refuse or garbage container is reached can be a serious problem. Further, pet owners often must carry a box carrying a supply of fresh plastic bags from which to select a fresh bag for performing their duty. The pet owner uses the selected bag to lift the fecal deposit from its site of deposit and tie or otherwise secure the loaded bag against leakage or breakage. In the course of such steps, their person or belongings can be soiled.

In other instances, pet owners have been forced to carry along a newspaper from which to tear off a portion for retrieving the fecal deposit and carry the deposit wrapped in such paper portion to an available refuse container which may comprise an open topped wire refuse container. Such container may be located some distance from the pick-up site. As can be anticipated, notwithstanding nuisance abating statutes and the health risk associated with the presence of such fecal deposits, dog excrement deposits are left unattended on public walkways, parks, side-walks and other urban areas.

Often, the dog owner is required to couple a dog to a leash when exercising the dog. When the dog owner takes his or her dog for a walk along a street or in a park to fulfill his obligation to enable the dog to exercise as well as to perform its eliminatory duty exterior of the dog's living quarters, after the walk has proceeded, discovery is made that the dog owner has failed to take along any convenient means required to retrieve and clean-up any fecal deposit made in the course of such outdoor exercise.

Such event creates an unwelcome problem for the dog owner in complying with the legal obligation and forces his or her return to the start location, pick-up the necessary disposal bags, pads, waste collecting and storage means and return to the site of the deposit, leaving the site soiled until he returns thereto. After collecting and temporarily storing the deposit, the adequate disposal station must be reached.

Many of the available prior art animal waste collection and storage means have been bulky, ungainly to carry and not easily employed without a risk of getting the fecal matter on his or her hands or apparal. One prior device incorporates a collapsible frame operative for supporting a bag in open condition and further includes a paddle or like means to engage the deposit and transfer the deposit into the bag. However, although the paddle must be cleaned immediately after use, there is usually no provision for the cleaning task on site since means for effecting the cleaning task often does not accompany the device. Even greater import is directed to the task of sanitizing the hands of the dog owner immediately after he or she has completed the task of "clean-up". If a cleaning cloth is supplied, it must be carried by the pet owner and discarded with any fecal material not removed therefrom, amplifying the risk of getting his or her hands soiled in the course of the clean-up activity. In addition, hand sanitizing means have been absent as a part of the available waste retrieval and storage means in view of the general bulk of containers for holding and dispensing a sanitizer composition as a part of the available animal retrieval and storage means. Available hand sanitation means must be carried separately as additional objects by the pet owner.

Kits have been provided which include a relatively large box whose content, in addition to providing a sealable area for holding the retrieved fecal material in sealed bags, include an absorbent material, a scoop, paddle or scraper for lifting the fecal matter from the surface upon which the fecal matter is deposited, a supply of fresh plastic bags, means for tying off these bags and a closable compartment for receiving and temporarily storing the loaded bags. Such kits often are cumbersome to use and transport. Use of such kits also may require gloves, towels, handiwipes and the like to be stored and periodically replaced, increasing the cost of the kit.

Even where provided, a paddle or scoop may not be efficient for picking up the fecal deposit or guiding the retrieved deposit into the plastic (or paper) bag in challenging deposits made in irregular terrain or in deep grass, for example. This can be frustrating to the pet owner, occassionally causing the user simply to leave the deposit site without picking up the fecal deposit. There remains an unanswered absence of adequate carrier means which provide for efficient temporary storage of the fecal matter and transport to a disposal facility subsequent to collection thereof. Another problem for which an adequate solution may not have been provided involves the prevention of leakage from the waste collecting means or temporary holder into which the retrieved fecal matter (and/or containers therefor) is deposited.

Of the prior patented art dealing with the problem concerned here, several patents of interest are considered as indicating the state of the art as to efforts to facilitate the handling of the collection of pet waste by pet owners. Of these patents, the following are of interest:

| Patentee | U.S., Pat. No. | Date |
|---|---|---|
| Roe | 5,363,809 | 11-15-94 |
| Hess | 5,560,,321 | 10-01-96 |
| Knudson | 5,713,616 | 02-03-98 |
| Conboy | 5,727,500 | 03-17-98 |

The Hess patent discloses a pouch-like dog waste carrier and plastic bag dispenser arrangement comprising a pair of pockets on either side of a dog harness to be worn by the dog. One pocket carries a dispenser box holding folded plastic litter bags. The dispenser box and said one pocket have matching slots through which the litter bags can be dispensed one at a time. The other pocket, absent the slot, is employed to hold "excrement loaded" litter bags tied closed and introduced therein. The pocket intended to carry the "loaded" plastic litter bags has a flap which is secured, via a "hook and pile" Velcro type closure on the flap and the exterior body of said pocket. ("Velcro" is a trademark of Velcro Internatonal, Inc. describing a "hook and pile" closure consisting of a piece of fabric of small hooks that stick to a corresponding fabric of small loops referred to as "pile" to denote a velvety surface having raised small loops). There are no additional pockets for carrying items other than the empty plastic litter bags and waste filled plastic litter bags. Rather than being secured to the animal's collar, the unit would have to be fitted onto a harness worn by the animal for each excursion, walk, etc.

The Roe patent provides a carrier comprising a pair of open-ended pouches formed by a hollow sheath bound mid-length in the form of a bow-tie by a band or knot to create a pair of opposite open-ended pockets. At least one of the pockets can be sealed with "hook and pile" (Velcro) fastening means to close off the open ends thereof. The "Velcro" closure or closures are inner positioned for sealing purposes. A self-locking strap is interfaced with a "bow-tie" knot and can be secured to the animal's collar or to a leash. The Roe carrier, when worn by the animal, soon would become unbalanced and difficult for the animal to wear. There is some question as to the capacity of the Roe carrier and the ability of the Roe carrier to retain the feces in the feces-loaded litter bags, even when the open top of the holder is secured together but not sealed about its opening.

Knudsen provides a purse-like receptacle having a chamber for receiving loaded plastic bags. This chamber has a closure flap which includes a pocket for containing fresh (unused) plastic litter bags, at least a pair of front pockets and a pair of foldable pleated side walls. The flap pocket is closed by a zipper. Likewise, a zipper is provided in at least one of the side walls for establishng selective access to one of the front pockets. the zipper in the side wall can extend around the bottom of the chamber to provide access to the entire interior of the chamber for cleaning, as necessary. Rings are attached by loops formed of canvas or secured to the receptacle. A belt can be threaded through the rings for transport of the receptacle by the pet owner wearing same.

The pocket in Knudsen for containing the plastic waste collection bags is accessible by manipulating a zipper. The full interior is lined with an absorbent material. Knudsen also secures the hook strip of a "hook and pile" Velcro-type fastener across the central portion of the flap along the longitudinal seam thereof and the "pile" strip of a "hook and pile" Velcro fastener across the central portion of the outer front surface of the receptacle to close the receptacle chamber when the flap is brought over the opening to the chamber and the "hook" strip engaged with the "pile" strip of the "hook and pile" Velcro closure. A pair of front pockets are formed in the front of the receptacle opening across the front thereof to receive a scoop paddle while the second pocket is intended to receive a portion of a collapsible frame or other tools. The interior facing flap pocket opens along the side of the flap interior thereof. A zipper is installed along each side of the receptacle to permit full opening of the receptacle (chamber and flap) to access the interior lining of the receptacle and flap. The collapsible frame is used, after being erected, to hold the bag open for introducing excrement therein using the scoop paddle. A conventional waterproofing composition is sprayed on the interior lining of the flap and the interior chamber to facilitate cleaning of the fully opened interior lining.

The Knudsen unit must be carried by the pet owner using a "shoulder strap" and cannot be carried by or worn by the pet. There remains a problem of cleaning the interior of the chamber, particularly if the pet waste is placed directly into the interior of the chamber. The opening of the flap pocket along the side of the flap exposes the interior of the pocket and the contents thereof to excrement introduced to the interior of the chamber when the paddle scoop is employed. Thus, many of the unmet needs of the earlier discussed prior art remain with the Knudsen proposed unit.

The Conboy patent describes a leash-mounted storage device which provides front and rear pouches attached together defining a channel to accommodate the passage of a leash. The leash is passed through the channel between the front and rear pouches. Both the front and rear pouches are foldable for transport. The front pouch has a longitudinal overlapping opening for receiving a supply of disposable litter bags and, has an open top provided with a "hook and pile" Velcro closure at the interior of the mouth of the open top. The rear pouch is attached to the back of the front pouch to define the channel. A pair of "hook and pile" Velcro fastening straps are secured to the back of the front pouch at spaced positions. One of the fastening straps is passed through the hand-loop of the leash while the other of the fastening straps is wrapped around an intermediate length of the leash to secure the storage portion at a fixed position along the leash.

In the Conboy unit, the front pouch has a top opening but remains folded until used. The front pouch receives the waste-loaded closed and tied litter bags when the pouch is unfolded. The "hook and pile" Velcro closure is positioned at the lower exterior closed end of the front pouch to support the front pouch in folded condition. The Conboy storage device can used for holding useful pet-related items such as pet toys, pet medication, water container, etc. when not used for carrying the waste-loaded litter bags. However, there is no provision for carrying any of these items in either of the front or rear pouches if one or the other or both are used to carry waste-loaded litter bags. The Conboy storage device must be hand-carried by the hand loop of the leash and cannot be carried by the animal.

The applicant's copending patent application provides a sanitary pet-waste collection pouch for the collection and temporary storage of animal waste, said pouch is formed of non-absorbant woven fabric having opposite interior and exterior sides, the former being smooth and the latter being grained. The pouch has front, rear and opposite side walls defining an interior open-topped chamber for holding plural tied and sealed animal waste-containing plastic litter bags, a flap cover unitary with the front wall and extendable over the chamber, the flap cover carrying an interior opening pocket and an exterior opening pocket. The interiors of the chamber and each of the interior and exterior opening pockets are lined with a non-absorbent material.

Each of said interior and exterior opening pockets include "hook and pile" closures. The flap cover has a "hook" strip of a "hook and pile" closure while the rear wall carries an angularly oriented elongate "pile" strip of said "hook" and "pile" closure secured thereto, together defining said "hook and pile" closure functioning adjustably to close the pouch. The the "hook" strip being engaged with the "pile" strip at any selected location along the length thereof whereby adjustably to close the pouch even when the girth of the chamber is expanded due to the number of tied and sealed loaded pet-waste containing plastic litter bags.

A supply of fresh plastic litter bags is contained within the interior pocket of the flap cover for dispensing therefrom. Flat personal effects of the pet owner can be received within the exterior opening pocket of the flap cover.

A pair of opposite, top-opening deep side-pockets are secured to each of the opposite side walls along the length thereof. A thin strap is doubled to form a loop and a pair of matching ends, said ends being secured within one of said top-opening deep side-pockets with the loop extending outward from the open end of said one top-opening deep side pockets. A strap is passed through said loop and secured thereto. Likewise, a second thin strap is doubled to form a second loop and a pair of ends, said ends being secured within the other one of said top-opening deep side-pockets with the second loop extending outward from the open end of said other one of said top-opening deep side pockets.

Each of a pair of broad straps are passed through respective ones of said loops and secured thereto. Each broad strap is provided with opposite ends, the opposite surfaces of which respectively carry the "hook" and the "pile" portions of a "hook and pile" closure along opposite ends. The "hook" and the "pile" portions adapted to be engaged so as to define respective retainer loops which extend outward from the respective side pockets. Each of the thus formed loops may be selectively disengaged either to wrap around the animal leash or be threaded about a belt worn by the pet owner and re-engaged. This enables the pouch selectively to be posititioned along the leash or be placed fixedly at any location along the leash. The diameter of each loop can be increased or lowered simply by disengaging and re-engaging said strap ends. One loop can be passed through the ring which generally may be provided on the dog's collar. One of the loops can be opened with the ends passed through the handle of the leash and re-engaged. Thus the pouch can be carried or worn by the pet owner, can be coupled to the handle of the leash or to the leash itself, and, can be coupled to the collar of the pet and carried thereby.

One of the deep side-pockets is adapted to receive a hand-sanitizer dispensing container provided with a dispensing spout. An elastic retainer band was looped and secured within said one deep side-pocket so as to retain the hand-sanitizer container within said one deep side-pocket. A pull portion of the elastic retainer is provided to be grasped by the pet-owner to access the container for enabling the hand-sanitizer composition to be utilized, when needed.

The second thin strap extends outward of the open-top of said other one of said deep side-pockets, the free end of said second thin strap being coupled to a spring-biased key fob capable of holding the pet-owner's keys, with the keys and key fob and strap stored within said other one of said deep side-pockets. In addition, the said other one of said deep side-pockets can receive personal items such as pens, pencils, screw-driver of other similar tools.

Notwithstanding the advantages of Applicant's earlier sanitary pet-waste collection holder, it has become desirable to simplify construction of the sanitary pet waste collection holder disclosed and claimed in my pending patent application so as appreciably to reduce the cost of manufacturing same without the loss of the principal benefits obtainable with use thereof.

BRIEF SUMMARY OF THE INVENTION

The invention provides a sanitary animal waste collection pouch for the collection and temporary storage of pet waste, said pouch having having front, rear and opposite side walls defining an open-topped chamber for receiving pet-waste containing tied plastic litter bags and having a flap cover carrying an exterior opening pocket and an interior opening pocket. A top opening side pocket is secured to one of said side walls and has a restricted opening at the bottom thereof for receipt of the dispensing head of a hand-sanitizer container which is seated within said side-pocket.

The exterior opening pocket has an entrance closed by a first "hook and pile" closure secured therein within said entrance, said flap cover and said front wall having the "hook" portion of a second "hook and pile" closure being longer than said "hook" portion of said second "hook and pile" closure and being secured to the surface of said front wall at a location disposed angularly thereon relative to said "pile" portion with the flap cover extending over the opening of the chamber and closing the chamber.

The side-pocket has a restricted opening at the bottom thereof. A sanitizer dispensing container is seated within said side-pocket and has a dispenser head engaged through said restricted opening. The flap cover is adapted to extend over the opening of the chamber and the said "hook" portion being engagable with the "pile" portion at any selected location along the length thereof so as to close the pouch independently of the girth thereof when the chamber is filled with plural tied pet-waste containing plastic litter bags. The interior opening pocket is capable of containing and dispensing fresh plastic litter bags while the exterior pocket is capable of storing personal effects, such as credit cards, identification cards, money and the like. The side pocket has a bottom opening and a hand-sanitizer container having a dispensing cap being slidably seated within said side pocket with the dispenser cap passing through said bottom opening for selective access thereto with the hand-sanitizer retained within said side pocket.

A pair of elongate straps are secured each to the respective upper ends of said side-walls and extend upwardly outwardly therefrom. Each of the elongate straps have "hook" and "pile" closure portions secured on respectively opposite surfaces thereof and are adapted to be releasably self-engaged forming a pair of retainer loops capable of being fixedly secured and/or slidably engaged on one of a pet leash, a pet collar and/or a belt worn by the pet owners.

BRIEF ASCRIPTION OF THE DRAWINGS

Figure 1:
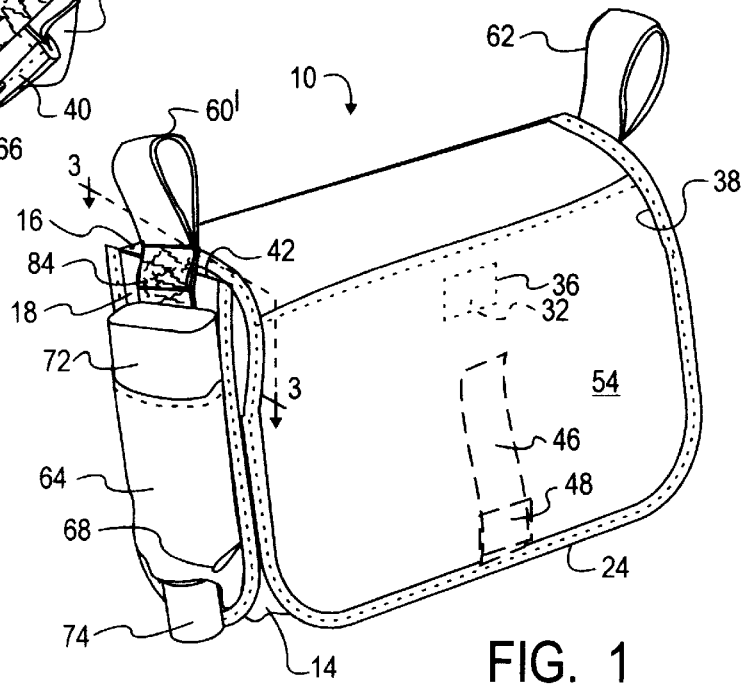
FIG. 1 is a front perspective view of the sanitary pet-waste collection and storage pouch according to the invention shown in closed condition.
Figure 4:
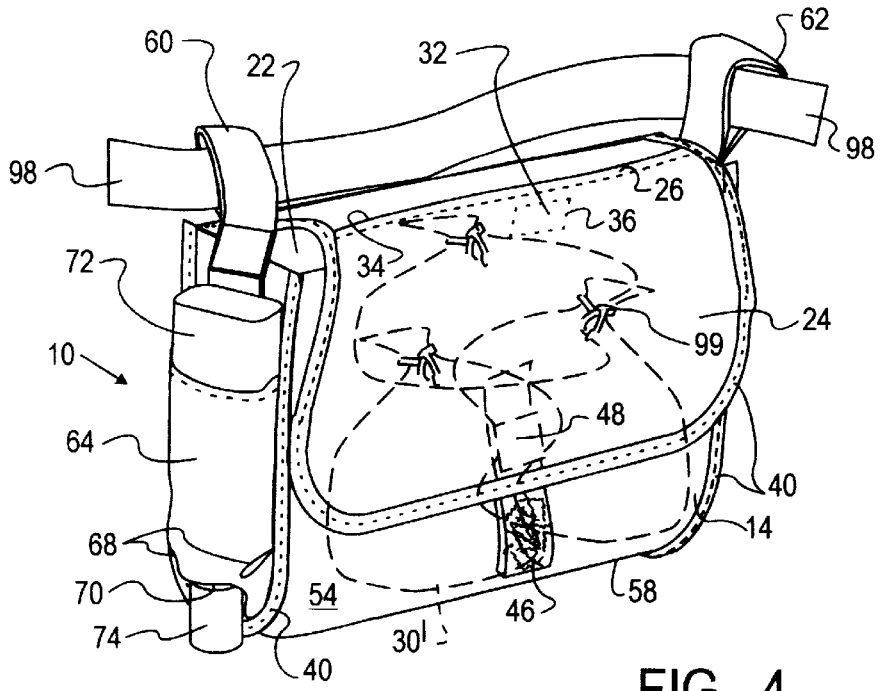
Figure 5:
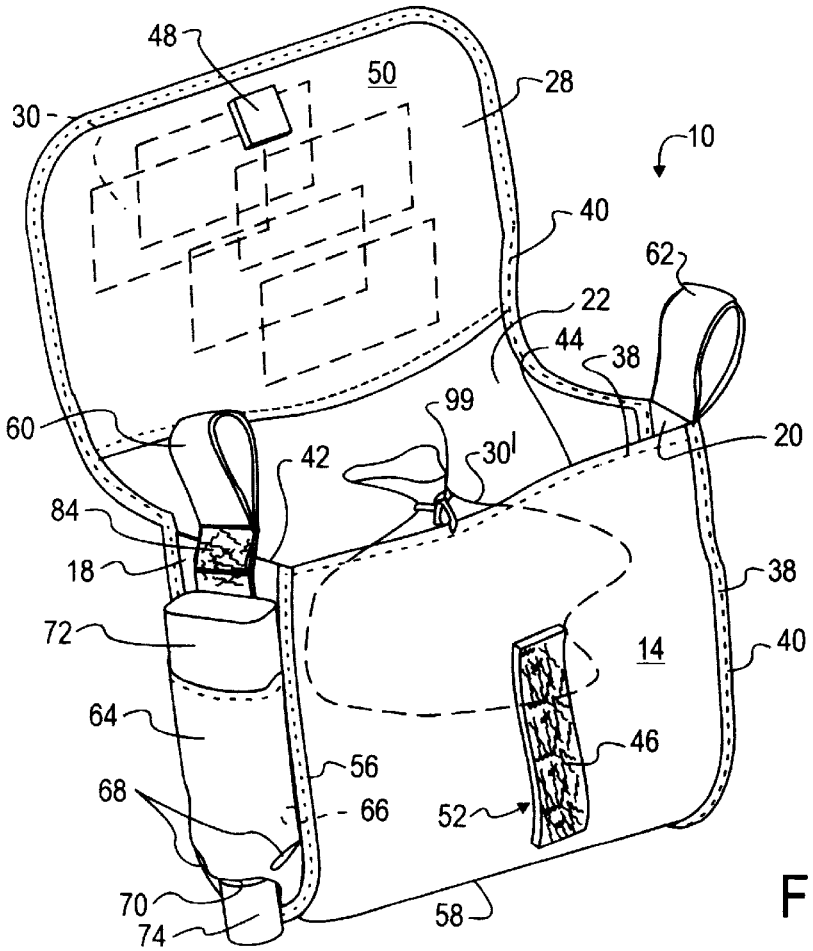

FIG. 4 is a front perspective view of the sanitary pet-waste collection and storage pouch shown in FIG. 1 illustrated in a closed condition, the portions in phantom representing several tied and sealed plastic litter bags disposed within the chamber of the pouch; and, FIG. 5 is a front perspective view of the sanitary pet-waste collection and storage pouch shown in FIG. 4 illustrated in opened condition, the portions in phantom representing, respectively, fresh empty plastic litter bags disposed within the interior opening pocket carried by the flap cover, a fresh one of said empty plastic litter bags shown in the process of being dispensed from said interior opening pocket, and illustrating a tied and sealed pet-waste loaded tied and sealed plastic litter bag shown in the process of being deposited within the chamber of the sanitary pet-waste collection and storage pouch.

DESCRIPTION OF A PREFERRED EMBODIMENT OF THE INVENTION

Briefly, the sanitary pet-waste collection and storage pouch according to the invention is similar to the sanitary pet-waste collection and storage pouch disclosed in my pending patent application, but simpler in construction and more economical to manufacture without loss in beneficial function.

Referring now to FIG. 1, the sanitary pet-waste collection and storage pouch of the invention is represented generally by reference character 10 and comprises a hollow body 12 having front and rear walls 14, 16 and opposite side-walls 18, 20 defining a top opening chamber 22. The side-wall 18 is viewable in FIG. 1 while the side-wall 20 is viewable in FIG. 2. The rear wall 16 is extended at its upper end to define a flap cover 24. The flap cover 24 has an exterior opening pocket 26 and an interior opening pocket 28 superposed one on the other. The interior opening pocket 28 is adapted to contain plural fresh plastic litter bags 30 for use in retrieving and storing the pet-waste from its site of deposition. The exterior opening pocket 26 is intended to contain certain of the personal effects of the pet owner such as identification cards, driver's licenses, credit cards, cash, etc. as will be described hereinafter.

The exterior opening pocket 26 includes a "hook and pile" Velcro closure 32 sewn in place within said pocket 26 adjacent the opening 34 of the pocket 26 for closing off the interior thereof as indicated by the stitching 36 visible in FIG. 1. The edges 38 of the body 12 are bound along their length by binding 40 except for the upper edges 42 of the side-walls 18 and 20. The upper edges 42 of the side-walls 18 and 20 are bent back and stitched to "finish" said edges 42. The other edges 44 of the interior opening pocket 28 and the chamber 22 also are finished in the same manner as edges 42.

The flap cover 24 has a "hook" portion 48 of a second "hook and pile" Velcro closure 52 secured to the outer surface 50 of the interior opening pocket 26 at a location adjacent the closed edge thereof. The front wall 14 has the "pile" portion 46 of said second "hook and pile" Velcro closure 52 secured to the surface 54 thereof. The said "pile portion" 46 is oriented angularly, preferably perpendicular and centered between the opposite edges 56 of said front wall 14 and extending upward from the bottom edge 58 thereof. The "pile" portion 46 is longer than the "hook" portion 48 so that when the flap cover 24 is brought over the open chamber 22, the "hook" portion 48 of said second "hook and pile" closure 52 is engaged at any location along the length of the "pile" portion 46 depending upon the girth of the tied pet-waste loaded litter bags 30' within the chamber 22, whereby the pouch 10 is closed.

It should be understood that the individual "hook" portions and the "pile" portions as provided described herein and hereinafter combine in engagement to form the combination known as the "hook and pile" Velcro closure. (Velcro is the trademark of Velcro International, Inc.)

Retainer loops 60 and 62 are secured to the respective upper edges 42 of the side-walls 18 and 20. The side-wall 18 carries an open-topped side-pocket 64 formed of a generally rectangular sheet of the same non-absorbant material from which the pouch 10 is constructed. The longitudinal edges 66 (shown in phantom representation) of said side-pocket 64 are bound to the side-wall 18 by the binding 40.

Figure 3:
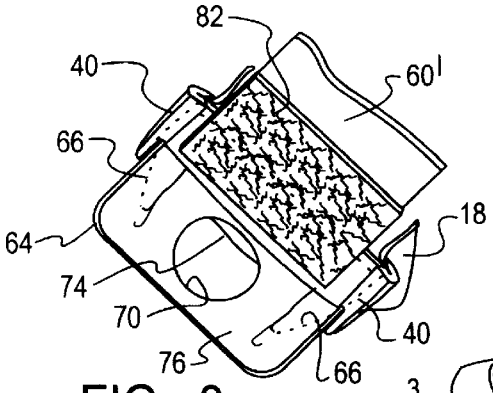
FIG. 3 is a an enlarged fragmentary sectional view taken through line 3—3 of FIG. 1 and in the direction indicated by the arrows, shown with the dispensing container removed.

As illustrated in FIG. 3, a restricted opening 70 is formed in the bottom of the side-pocket 64 by forming same in the rectangular sheet which forms said side-pocket 64 prior to being bound to the side-wall 18. A pair of tucks 68 are formed in the side-pocket 64 at a location near the lower end thereof, reducing the diameter of said side-pocket defining said restricted bottom opening 70 and also defining an interior shoulder 76 (visible in FIG. 3) bordering said restricted bottom opening 70 of the of said side-pocket 64.

Referring to FIG. 1, a hand-sanitizer dispensing container 72 which has a dispensing cap 74 is selected to have a configuration, here rectangular, and a dimension to enable the hand-sanitizer dispensing container 72 to slip slidably, fully into the side-pocket 64 through the open-top thereof, until the dispensing cap 74 of said hand-sanitizer dispensing container 72 passes through the restricted bottom opening 70 (see also FIG. 3). The hand-sanitizer container 48 conventionally includes a upper shoulder (not shown) surrounding the dispensing cap 74, said upper shoulder (not shown) resting upon the interior bottom shoulder 76 of the side-pocket 64. The particular shape of the hand-sanitizer dispensing container may differ from container to container, but the side-pocket provided may be formed to conform with the configuration of the container selected without departing from the scope of the invention described herein.

The hand-sanitizer dispensing container 72 holds a hand-sanitizing composition for cleaning the hands of the pet-owner after the pet-owner has performed the retrieval of the pet-waste from its deposition site and has deposited said pet-waste into the available plastic litter bags 30 and tied same so that the waste-filled litter bags 30' are tightly closed and sealed. The hand-sanitizer dispenser container 72 is self-retained within said side-pocket 64.

Referring again to FIG. 2, the sanitary pet-waste collection and storage pouch 10 illustrated rotated about 90 degrees from its disposition in FIG. 1 so that the other side wall 20 is visible. The retainer loops 60 and 62 are illustrated in opened condition so that the wide elongate straps 60' and 62' are illustrated in their condition prior to their respective self-engagement for forming said retainer loops 60 and 62. The elongate straps 60' and 62' are formed of webbing material and are respectively positively secured to the upper ends of the side-walls 18 and 20.

Figure 2:
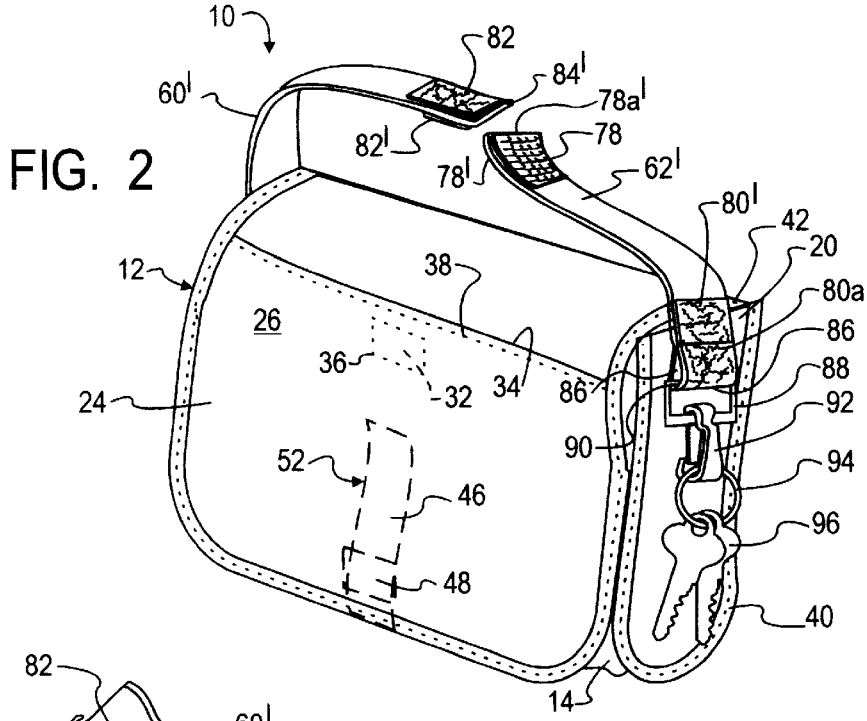
FIG. 2 is a front perspective view of the sanitary pet-waste collection and storage pouch illustrated in FIG. 1 but shown rotated 90 degrees.

Strap 60' is provided with a "hook" portion 84 adjacent one end 84' thereof (see FIG. 1, the "hook" portion 84 is not visible in FIG. 2). A "pile" portion 82 is secured to said strap 60' on the undersurface thereof at the opposite end of said strap 60' (visible in FIG. 1). An additional "pile" portion 82' is secured on the opposite surface of said strap 60' at said opposite end 84' thereof but is coextensive with the "pile" portion 82.

As shown in FIG. 2, the strap 62' is provided with "hook" portion 78 secured to the surface of said strap 62' at a location adjacent the free end 78'*a* thereof. A "pile" portion 80' is secured to the strap 62' at the opposite end 80*a* thereof but on the surface common with the surface carrying the "hook" portion 78.

In FIG. 2, the strap 60' also is illustrated with its "pile" portion 82' about to be engaged with the "hook" portion 78 carried by the strap 62' at end 78'*a* of the strap 62' so as to define a carrying handle for the pouch 10. The strap 62' is turned back upon itself to expose the "pile" portion 80' and to form the end 80*a* thereof into a shallow loop 86 and expose the portion 80' sufficiently to enable the retainer loop 60 to be formed.

In FIG. 2, the flap cover 24 is illustrated overlying the open interior chamber 22 of the pouch 10 and engaged upon the front wall 14 thereof. A U-shaped key-fob holder 88 having a bridging bar 90 is illustrated in FIG. 2. The bridging bar 90 is shown seated within said shallow loop 86. The spring-biased key-fob 92 is coupled to the key-fob holder 88 and is shown carrying a ring 94 holding the selected keys 96 of the pet owner.

In FIG. 4, the sanitary pet-waste collection and storage pouch 10 of the invention is illustrated in a closed condition filled with tied sealed loaded plastic litter bags 30' containing retrieved pet waste contained within the interior chamber 22 of the pouch 10. As illustrated, the pouch 10 is in its closed condition as carried on a belt 98 as worn by the pet owner, the belt 98 being passed through the retainer loops 60 and 62. The flap cover 24 is shown extending over the open chamber 22 in which several pet-waste loaded plastic litter bags 30' are disposed. The flap cover 24 is adhered to the front wall 14 of the pouch 10 by engaging the "hook" portion 48 of the "hook and pile" Velcro type closure 52 at a location along the length of the "pile" portion 46 carried by the front wall 14 less than the length of said "pile" portion 46 so that the chamber 22 is firmly closed even though the girth of the chamber 22 of pouch 10 has been expanded due to the number of pet-waste loaded tied and sealed plastic litter bags 30' enclosed therein.

FIG. 5 illustrates the sanitary pet-waste collection and storage pouch 10 in an opened condition exposing the open chamber 22. A tied plastic litter bag 30' which has been filled with pet-waste is illustrated entering into the chamber 22. Plural fresh plastic litter bags 30 in phantom line representation are shown within the interior opening pocket 28 for storage therein ready to be dispensed. The pet-waste loaded plastic litter bag 30' is tied tightly to seal same using a conventional tie strip 99 so that the loaded plastic litter bag 30' bag is sealed against leakage. The tied loaded plastic litter bag 30' is illustrated within the chamber 22 in the form in which it will be stored fully within the chamber 22 when the flap cover 24 is brought over the chamber 22 and the "hook" portion 48 and the "pile" portion 46 on the flap cover 24 and the front wall 14 respectively are engaged establishing the "hook and pile" Velcro type closure 52 to close the pouch 10 with the flap cover 24 tightly engaged on the front wall 14 of the pouch 10. The hand-sanitizer dispensing container 72 is illustrated as carried within the side-pocket 64 of the pouch 10 when worn or carried by the pet owner or by the pet. Additional tied loaded plastic litter bags 30' may be added to the one disposed within the chamber 22. The hand-sanitizer dispensing cap 74 carried by the hand-sanitizer container 64 is easily and conveniently accessible for use by the pet owner.

It should be understood that the size of the sanitary pet-waste collection and storage pouch 10 can vary with the size of the pet concerned. Various minor changes and modifications to the embodiment of the invention described herein for purposes of illustration may occur to those skilled in the art without departing from the spirit and scope of the invention as claimed.

What I claim is:

1. A sanitary pet-waste collection pouch having front, rear and side walls defining an open-topped interior chamber, a flap cover unitary with said rear wall foldable over said chamber and engagable on said front wall, said flap cover having exterior opening and interior opening pockets, strap means secured to said side-walls and adapted to define retainer loops for carrying said pouch, said strap means having first "hook and pile" closure means capable of forming retainer loops for carrying said pouch, said flap cover and said front wall carrying second "hook and pile" closure means capable of adjustable engagement independently of the girth of said chamber closing said pouch, an open-topped side-pocket along at least one of said side-walls and secured thereto, said side-pocket having a restricted bottom opening and a hand-sanitizer dispensing container having an upper shoulder and a dispensing cap thereon, said hand-sanitizer dispensing container being slidably seated within said side-pocket with said dispensing cap passing through said bottom opening retaining said hand-sanitizer dispensing container within said side-pocket.

2. The sanitary pet-waste collection pouch according to claim 1 in which said interior pocket is capable of receiving plural plastic litter bags for dispensing therefrom.

3. The sanitary pet-waste collection pouch according to claim 1 in which said exterior opening pocket is capable of receiving and holding selected pet owner's personal effects, said exterior opening pocket having a third "hook and pile" closure means for closing said exterior opening pocket.

4. The sanitary pet-waste collection pouch according to claim 1 in which said second "hook and pile" closure means comprise second "hook" and "pile" portions, one of said second "hook" and "pile" portions being secured to said flap cover exterior of said interior opening pocket and spaced from the closed end thereof, and the other one of said second "hook" and "pile" portions" being secured to said front wall oriented substantially centrally thereon at an angle between the edges thereof, whereby said one of said second "hook" and "pile" portions is engaged with said other of said second "hook" and "pile" portions at any selected location along the length thereof depending upon the girth of said chamber.

5. The sanitary pet-waste collection pouch according to claim 1 in which said first "hook and pile" closure means are secured at the respective ends of said straps, said elongate straps being engagable defining a carry handle for carrying said pouch.

6. The sanitary pet-waste collection pouch according to claim 1 in which said strap means comprise first and second elongate straps respectively secured to said side-walls, said first and second elongate straps each having "hook" portions and "pile" portions of said first "hook and pile" closure means secured at the ends of each said elongate strap, each of said elongate straps being capable of forming said respective retainer loops by engaging said "hook" and said "pile" portions thereof.

7. The sanitary pet-waste collection pouch according to claim 1 in which said strap means comprise first and second elongate straps, each having opposite ends, one end thereof being secured respectively to said side-walls, each elongate strap having a "hook" portion of said "hook and pile" closure means and a "pile" portion of said "hook and pile" closure means secured respectively to the surface of each of said elongate straps at opposite ends thereof.

8. The sanitary pet-waste collection pouch according to claim 1 in which said strap means comprise first and second elongate straps, each having opposite ends, one end being secured respectively to said side walls, said first strap having a first "hook" portion and a first "pile" portion of said first "hook and pile" closure means secured respectively thereto at said opposite ends thereof, and an additional "pile" portion secured to said first elongate strap on the opposite surface thereof beneath said first "pile" portion of said first "hook and pile" closure means, and, said second elongate strap having a second "hook" portion and a second "pile" portion of said first "hook and pile" closure means secured thereto at the opposite ends thereof, said second "pile" portion of said second elongate strap capable of being turned back upon itself, bent and secured to the adjacent side wall defining a shallow loop, a U-shaped key-fob holder having a bridging bar, said bridging bar being journaled within said shallow loop, a key-fob coupled to said U-shaped key-fob holder, said key-fob capable of holding selected keys of the pet owner, said first and second elongate straps capable of being engaged at their ends by engagement of said respective "hook" portions and "pile" portions.

9. A sanitary pet-waste collection pouch having front, rear and side-walls defining an open-topped chamber capable of storing at least one tied pet-waste loaded plastic litter bag, a flap cover unitary with said rear wall and being foldable over said chamber covering said chamber, said flap cover and said front wall having a "hook and pile" closure means capable of being engaged closing said pouch, at least one open-topped side-pocket secured along one of said side-walls, said side-pocket having a restricted bottom opening, and a hand-sanitizer dispensing container having a dispensing cap thereon, said hand-sanitizer dispensing container being slidably retainably received within said side-pocket with said dispensing cap passing through said restricted bottom opening.

10. The sanitary pet-waste collection pouch according to claim 9 in which said side-pocket has tucks formed adjacent the bottom end thereof whereby to narrow said side-pocket adjacent the bottom end thereof whereby to effect restriction of said bottom opening.

11. The sanitary pet-waste collection pouch according to claim 9 in which the bottom end of said side-pocket has a shoulder surrounding said restricted bottom opening, portions of said hand-sanitizer container including a shoulder surrounding said dispenser cap, said shoulder of said hand-sanitizer container being seated on said shoulder of said side pocket when said dispenser cap is fully passed through said restricted bottom opening.

12. The sanitary pet-waste collection pouch according to claim 9 in which said flap cover has an exterior opening pocket and a "hook and pile" closure disposed within said exterior opening pocket.

13. The sanitary pet-waste collection pouch according to claim 12 in which said flap cover has an interior opening pocket being capable of receiving fresh plastic litter bags therein and said exterior opening pocket is capable of receiving selected personal effects of said pet owner.

14. The sanitary pet-waste collection pouch according to claim 9 and strap means secured to each of said side-walls and having an additional "hook and pile" closure means enabling each strap to be formed into retainer loops capable of receiving a belt worn by said pet owner.

15. The sanitary pet-waste collection pouch according to claim 9 and strap means secured to each of said side walls, said strap means comprise a pair of elongate straps, each of said elongate straps carry one of a "hook" portion and a "pile" portion of a "hook and pile" closure means and are engaged defining a carrying handle for said pouch.

16. The sanitary pet-waste collection pouch according to claim 9 and an elongate pet leash, strap means secured to each of said side walls and having additional "hook and pile" closure means, said strap means comprising first and second elongate straps, each capable of being formed into retainer loops capable of receiving said pet leash therethrough via said additional closure means.

17. The sanitary pet-waste collection pouch according to claim 9 and strap means secured to each side wall, said strap means comprise a pair of elongate straps secured to respective side-walls and second "hook and pile" closure means carried by said strap means being releasably engagable to form a handle for carrying said pouch.

18. A sanitary pet-waste collection pouch having front, rear and opposite side walls defining an open-topped interior chamber, a flap cover unitary with said rear wall and foldable over said interior chamber covering same, said flap cover having interior and exterior opening pockets on opposite sides thereof, first "hook and pile" releasable closure means secured within said exterior opening pocket, strap means capable of defining exterior retainer loops secured respectively to said side-walls and extending outward therefrom, an open-topped side-pocket along one of said side walls and secured thereto, said side-pocket having a restricted bottom opening, a hand-sanitizer dispensing container having a dispensing cap, said hand-sanitizer dispensing container slidably seated within said side-pocket with said dispensing cap passing through said restricted bottom opening, said hand-sanitizer dispensing container being self-retained within said side-pocket, second "hook and pile" closure means secured to said flap cover and said front wall, said second "hook and pile" closure means comprise a "hook" portion and a "pile" portion, one of said portions being longer than the other of said portions, the longer of said portions being secured to said front wall and the shorter of said portions being secured to said flap cover whereby said shorter portion is engagable with said longer portion at any location along the length thereof thereby closing said pouch independent of the girth of said pouch resulting from the stored contents thereof.

19. The sanitary pet-waste collection pouch according to claim 18 in which said strap means includes a pair of elongate straps, one of said elongate straps carrying a hook portion and a "pile" portion of a third "hook and pile" closure means, said portions being carried on said elongate strap at respective opposite ends thereof and said other of said elongate straps carrying a "hook" portion and a "pile" portion of a fourth "hook and pile" closure means at opposite ends thereof whereby said respective "hook" and "pile" portions of said elongate straps are engaged respectively forming a pair of retainer loops, one retainer loop at each side-wall.

20. The sanitary pet-waste collection pouch according to claim 18 in which said strap means include a pair of elongate straps secured to said side wall, one of said elongate straps carrying a first "hook" portion and the other of said elongate straps carrying a first "hook" portion and a first "pile" portion of an additional "hook and pile" closure means, said first "hook and pile" portions of said additional "hook and pile" closure means respectively being carried at opposite ends of said elongate straps and being capable of engagement forming a handle for carrying said pouch.

21. The sanitary pet-waste collection pouch according to claim 19 in which said other of said elongate straps have said "hook" and "pile" portion on the same surface of said elongate strap, said other elongate strap being turned back upon itself at one end thereof and secured to one of said side walls defining a shallow loop and a key-fob holder journaled within said shallow loop and capable of carrying a key-fob thereon.

* * * * *